United States Patent [19]

Basquin et al.

[11] Patent Number: 4,867,851

[45] Date of Patent: Sep. 19, 1989

[54] PROCESS FOR REGULATING THE ACIDITY OF ALL-HÉOULT ELECTROLYTIC CELLS

[75] Inventors: Jean-Luc Basquin; Benoît Sulmont, both of St Jean de Maurienne, France

[73] Assignee: Aluminium Pechiney, Paris, France

[21] Appl. No.: 244,147

[22] Filed: Sep. 14, 1988

[30] Foreign Application Priority Data

Sep. 18, 1987 [FR] France ..... 87 13543

[51] Int. Cl.[4] ..... C25C 3/06; C25C 3/22

[52] U.S. Cl. ..... 204/67; 204/245; 204/246; 204/247

[58] Field of Search ..... 204/67, 243 R, 244–247

[56] References Cited

U.S. PATENT DOCUMENTS

| | | | |
|---|---|---|---|
| 3,248,177 | 4/1966 | Grolee | 204/67 X |
| 3,760,565 | 9/1973 | Fish | 204/67 X |
| 3,827,955 | 8/1974 | Bahri et al. | 204/247 X |
| 4,053,375 | 10/1977 | Roberts et al. | 204/67 |
| 4,062,696 | 12/1977 | Ducote | 204/67 X |
| 4,176,019 | 11/1979 | Dethloff | 204/247 X |

*Primary Examiner*—Donald R. Valentine

*Attorney, Agent, or Firm*—Dennison, Meserole, Pollack & Scheiner

[57] ABSTRACT

The invention relates to a process for regulating the acidity of the electrolytic bath by recycling fluorinated effluents emitted by the Hall-Héroult electrolytic cells for the production of aluminum, in which said fluorinated effluents are collected, by the dry route, on the alumina. It comprises the following stages:

a reference value for the fluorine/alumina weight ratio is fixed in connection with the alumina leaving the collecting apparatus, a continuous measurement takes place of the fluorine and alumina quantities entering the collecting apparatus, the alumina flow rate is regulated so as to maintain the $F/Al_2O_3$ ratio at its reference value, generally fixed between 0.5 and 3%, fluorinated alumina is fed into a storage means with a predetermined capacity and equipped with a level measuring means, the electrolytic cells are supplied with the fluorinated alumina taken from the storage means and the acidity of each cell is adjusted through the addition of aluminum fluoride and/or varying the power dissipated in the cell.

4 Claims, No Drawings

PROCESS FOR REGULATING THE ACIDITY OF ALL-HéOULT ELECTROLYTIC CELLS

TECHNICAL FIELD OF THE INVENTION

The present invention relates to a process for regulating the acidity of the cryolite bath of Hall-Héroult cells by the controlled recycling of the fluorinated effluents emitted by said cells. Thus, it relates to the technical field of the production of aluminium by igneous electrolysis of alumina dissolved in a bath based on cryolite melted at a temperature of approximately 930° to 970° C.

STATE OF THE ART

The production of aluminium by the Hall-Héroult process makes use of an electrolyte essentially constituted by sodium cryolyte $Na_3AlF_6$. It is standard practice to add to the cryolite various additives with a view to somewhat reducing its melting point, the most important of these being aluminium trifluoride $AlF_3$. This leads to an electrolyte, whereof the $NaF/AlF_3$ mass ratio is below 1.5 and can e.g. reach 1. The term acid is often used in connection with an electrolyte having a $NaF/AlF_3$ mass ratio below 1.5 and its acidity is expressed by the value of this ratio, called the bath ratio.

An operating Hall-Héroult cell emits fluorinated gaseous effluents, essentially in the form of hydrofluoric acid. For example, this emission can reach 30 kg (counted in fluorine) per tonne of aluminium produced and therefore substantially for two tonnes of alumina consumed.

In most modern installations, the fluorine is collected by fixing on the pure alumina, which is then used for supplying electrolytic cells. As a function of the particular case, part or all said alumina is used for fixing the fluorinated emissions collected on the cells. The thus fluorinated alumina is stored in bins and the electrolytic cells are supplied therefrom.

The problem which arises is that in the existing collecting systems, the fluorine content of the alumina having traversed the gas defluorination system fluctuates between extreme values of approximately 0.5 and 3% (by weight of F). However, it is essential that the fluorine supplies to the electrolyte are preferably controlled so as to maintain its acidity, in the manner defined hereinbefore, at a predetermined constant value and this will not be the case if the alumina has a fluctuating fluorine content.

European patent application EP 195142 A1 proposes a method for indirectly controlling the $NaF/AlF_3$ mass ratio based on monitoring the temperature of the electrolyte. Thus, for a constant electrolysis intensity, there is a relationship between the (measured) temperature of the bath and its acidity. The process consequently consists of fixing a reference temperature Tc and a reference rate for the addition of the pure $AlF_3$ to the bath, permanently comparing the measured values with the reference values and adjusting the $AlF_3$ additions in kg/24 h in order to bring the parameters to the reference value. However, this process only considers the pure $AlF_3$ additions and does not take account of the recycling levels of the fluorine emitted by the electrolytic cells and does not suggest any means for solving this problem.

OBJECT OF THE INVENTION

The object of the invention is a process for regulating the acidity of the electrolytic bath for the production of aluminium by controlling the addition of fluorinated products and recycling of the fluorinated effluents fixed to the alumina in a fumes treatment installation, characterized in that it comprises the following stages:

a reference value is fixed for the fluorine/alumina weight ratio for the alumina leaving the effluent treatment apparatus, the quantity of fluorine and alumina entering the effluent treatment apparatus is measured continuously or at predetermined intervals, the alumina flow introduced into the effluent treatment apparatus is regulated so as to maintain the $F/Al_2O_3$ ratio at its reference value, homogeneously fluorinated alumina is passed into a storage means with a predetermined capacity and which is equipped with a level measuring means, the electrolytic cells are supplied in homogeneous manner with fluorinated alumina taken from the storage means and the acidity of each cell is adjusted on the basis of the addition of aluminium fluoride and/or the variation of the electric power dissipated in the cell.

For performing this process, a number of parameters is used as a basis and certain of these are imposed by the electrolytic process:

the alumina supply rate, imposed from the time when the electrolytic intensity is fixed and which is e.g. 4 tonnes/day/cell for cells operating under 280,000 amperes, the fluorine emission by the cell (over a 24 hour period), approximately 30 (±10) kg per tonne of aluminium, i.e. approximately 15 kg per tonne of alumina introduced into the cell;

whereas others can be modified within certain limits:

the acidity of the electrolytic bath ($NaF/AlF_3$ mass ratio), the pure alumina quantity introduced into the device for collecting the fluorinated emissions of a group of cells (series or part of the series) and it is essentially the latter parameter which is to be influenced.

DESCRIPTION OF THE INVENTION

The stages of the process are as follows:

(1) A reference value is fixed for the $F/Al_2O_3$ weight ratio for the alumina leaving the effluent processing apparatus, said ratio being between approximately 0.5 and 3% and preferably close to 1.5%, which corresponds to the collecting of 30 kg of fluorine per tonne of aluminium produced or approximately 2 tonnes of alumina introduced into the cell.

(2) A continuous determination takes place of the fluorine flow rate in milligrams per second entering the effluent processing system and coming from the group of cells connected to said system by simultaneously measuring the fluorine concentration in the collected gases and their mass flow. The concentration measurement can be carried out by different processes, e.g. by an electrochemical method with a specific electrode, whose potential is linked with the fluorine flow rate by a prior calibration.

(3) A continuous measurement takes place of the pure alumina quantity introduced into the effluent treatment apparatus and which is brought into contact with the fluorinated gases. This measurement is also carried out by per se known processes, e.g. by passing the alumina onto an articulated blade supported by an elastic means, whereof the restoring torque is removed and which is linked with the flow rate by a relationship established by a prior calibration.

(4) The alumina is introduced into the effluent treatment apparatus by a device having a regulatable flow rate, so that action takes place on the latter so as to maintain or bring the value of the $F/Al_2O_3$ ratio to the reference value. The variable flow rate alumina distributor may but need not be that according to French patent 2575734 (=EP 190082) in the name of ALUMINIUM PECHINEY and which is based on the "potential fluidization" principle.

(5) The homogeneously fluorinated alumina is passed into an intermediate storage means having a predetermined capacity and which is equipped with a level measuring means. The group of cells in question is supplied therefrom with fluorinated alumina having a constant, known fluorine content.

(6) In addition, the following complimentary stage is introduced into the process. The storage capacity of the homogeneously fluorinated alumina is not unlimited. Thus, over a certain period, it may arise that the fluorine emissions have increased in such a way that, for a fixed reference value $F/Al_2O_3$, the fluorinated alumina stock increases to the point of saturating the bin. If it is wished to avoid costly manipulations and transfers of fluorinated alumina, it is preferable to increase the reference value of $F/Al_2O_3$ in order to make the fluorinated alumina production equal to its consumption, whilst adopting the opposite procedure when the bin is becoming exhausted. For example, it is possible to fix a high reference value and a low reference value for the fluorinated alumina level in the silo, whereby passing beyond one of these limits leads to an alarm as a result of which the reference value can be manually or automatically modified. Preferably, the upper limit is fixed at 90% of the capacity of the storage means and the lower limit is fixed at 10% of said capacity.

(7) With the control of the fluorine addition by the fluorinated alumina supplying the cells being assured, it is possible to individually adjust the acidity of each cell as a function of its individual disturbances, such as thermal variations and states, anode effect and anode change.

REALIZATION OF THE INVENTION

The invention was realized on a group of 105 electrolytic cells belonging to a series of 120 operating under an intensity of 280,000 amperes, said 105 cells being connected to a gaseous effluent collecting and treatment apparatus and independent from the remainder of the series. The acidity of the bath was fixed at the outset at 1.09 (bath ratio) corresponding to a melting point of 950° C. and the $F/Al_2O_3$ ratio in the apparatus was fixed at 1.50%.

The cells were supplied exclusively with fluorinated alumina and it was found that over the first few days the alumina level in the storage bin tended to increase. The reference value was then increased to 1.60%, so that the level in the silo firstly stabilized and then started to drop after a few days. The reference value was then lowered to 1.55 and this value ensured a quasi-stability of the level for several weeks.

At the end of the trial period, the mean acidity level was established at 1.09 (bath ratio) with a standard deviation of 0.1. During this period the individual disturbances to each cell were taken into account by tables known to the Expert.

ADVANTAGES RESULTING FROM THE INVENTION

The realization of the invention leads to a certain number of advantages in the operation of the electrolytic cells:

the operation of the cells is more stable, due to the fact that the bath acidity remains constant and therefore so does its melting point, which at the same time ensures the dimensional stability of the lateral slopes constituted by solidified electrolytic bath, the cells of the same series remain homogeneous because they are supplied with the same fluorinated alumina with a substantially constant fluorine content and a consequence of this improved stability is a slight increase in the Faraday efficiency, which is estimated at approximately ½ point.

We claim:

1. Process for regulating the acidity of the electrolytic bath of electrolytic cells by recycling fluorinated effluents emitted by Hall-Heroult electrolytic cells for the production of aluminium, in which these fluorinated effluents are collected, by a dry route, on alumina in an effluent treatment apparatus, characterized in that it comprises the following stages:
   - establishing a reference value for the $F/Al_2O_3$ weight ratio in connection with the alumina leaving the effluent treatment apparatus, while continuously measuring the fluorine and alumina quantities entering the effluent treatment apparatus;
   - regulating the alumina flow rate to maintain the $F/Al_2O_3$ ratio at the reference value;
   - passing the fluorinated alumina into a storage means with a predetermined capacity and equipped with a level measuring means;
   - supplying the electrolytic cells with fluorinated alumina taken from the storage means; and
   - adjusting the acidity of each cell by the addition of aluminium fluoride and/or varying the power dissipated in the cell.

2. Process according to claim 1, characterized in that the reference value for the $F/Al_2O_3$ weight ration is between about 0.5 and about 3%.

3. Process according to claims 1 or 2, characterized in that when the alumina level in the storage means passes beyond a predetermined upper or lower value, the $F/Al_2O_3$ reference value is modified to bring said level to a value between the upper and lower limits.

4. Process according to claim 3, characterized in that the upper limit is fixed at about 90% of the capacity of the storage means and the lower limit at about 10% of said capacity.

* * * * *

UNITED STATES PATENT AND TRADEMARK OFFICE

CERTIFICATE OF CORRECTION

PATENT NO. : 4,867,851

DATED : September 19, 1989

INVENTOR(S) : Jean-Luc BASQUIN et al

It is certified that error appears in the above-identified patent and that said Letters Patent is hereby corrected as shown below:

The correct title is:

--PROCESS FOR REGULATING THE ACIDITY OF HALL-HÉROULT ELECTROLYTIC CELLS--

Signed and Sealed this

Seventh Day of August, 1990

*Attest:*

HARRY F. MANBECK, JR.

*Attesting Officer*

*Commissioner of Patents and Trademarks*